United States Patent [19]

Yeh

[11] Patent Number: 4,968,884

[45] Date of Patent: Nov. 6, 1990

[54] VERTICALLY SENSITIVE OUTDOOR LIGHTING CONTROLS

[75] Inventor: Thomas Yeh, South Weymouth, Mass.

[73] Assignee: Sigma Instruments Inc., Weymouth, Mass.

[21] Appl. No.: 336,266

[22] Filed: Apr. 11, 1989

[51] Int. Cl.[5] ..... H01J 5/02

[52] U.S. Cl. ..... 250/239; 250/216

[58] Field of Search ..... 250/239, 221, 230, 214 AL, 250/214 B, 216; 356/317; 307/311; 315/150, 151

[56] References Cited

U.S. PATENT DOCUMENTS 4,722,607 2/1988 Anselment et al. ..... 250/239

*Primary Examiner*—David C. Nelms

*Attorney, Agent, or Firm*—Stanger, Michaelson, Spivak & Wallace

[57] ABSTRACT

In the disclosed outdoor lighting control, angular reflectors (52) direct vertical light passing through a translucent dome (38) onto a vertically oriented photocell (24) and a rigid vertically-adjustable sheet (54) between the photocell and the reflectors regulates the operating point of the photocell. The backs of the reflectors, and a socket (14) projecting vertically from a base (12) under the dome, shield the vertical photocell from horizontal light.

5 Claims, 6 Drawing Sheets

VERTICALLY SENSITIVE OUTDOOR LIGHTING CONTROLS

BACKGROUND OF THE INVENTION

This invention relates to outdoor lighting controls, particularly the type that turn on lamps in response to ambient light conditions.

Such controls are for example known from U.S. Pat. No. 3,353,762. They generally hold a photocell vertically and allow light to strike the photocell horizontally through a transparent opening in a cover that shields the photocell from vertical light. The base contains plugs for connecting the control to a network having the lamps to be switched on and off.

While such devices generally sense light coming from a horizontal direction such as North, it is often desirable to sense light coming from the overhead sources such as the sky. However, it is not often convenient to turn such control upwardly. On the other hand it is also inconvenient to manufacture different assemblies for different applications.

SUMMARY AND OBJECTS OF THE INVENTION

An object of the invention is to furnish outdoor lighting controls capable of responding to light from sources above the control for switching lamps on and off.

Another object is to simplify such devices.

According to the invention such objects are attained by using a horizontal base with a vertical photocell and directing vertical light rays toward the photocell with reflectors that block horizontal light to the photocell.

DETAILED DESCRIPTION OF PREFERRED EMBODIMENTS

Figure 1:
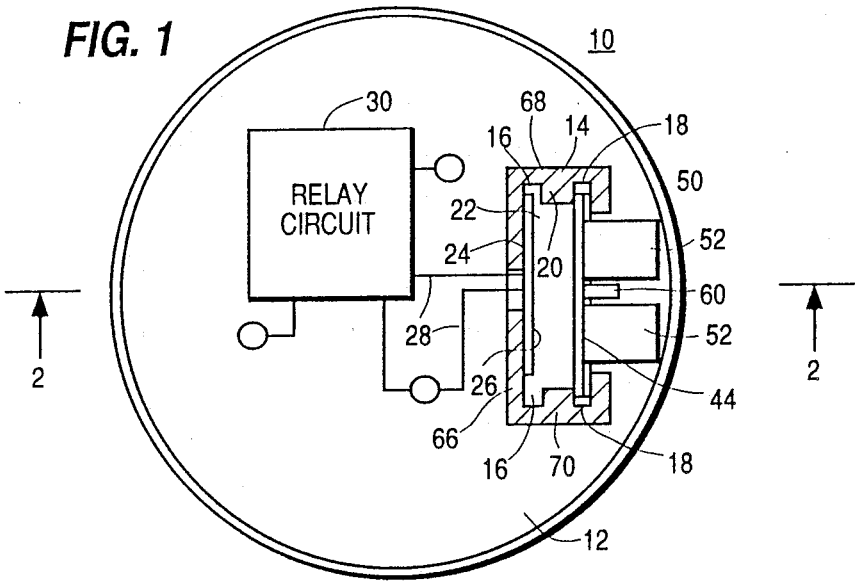
FIG. 1 is a partly schematic horizontal or plan section of a control embodying features of the invention.
Figure 2:
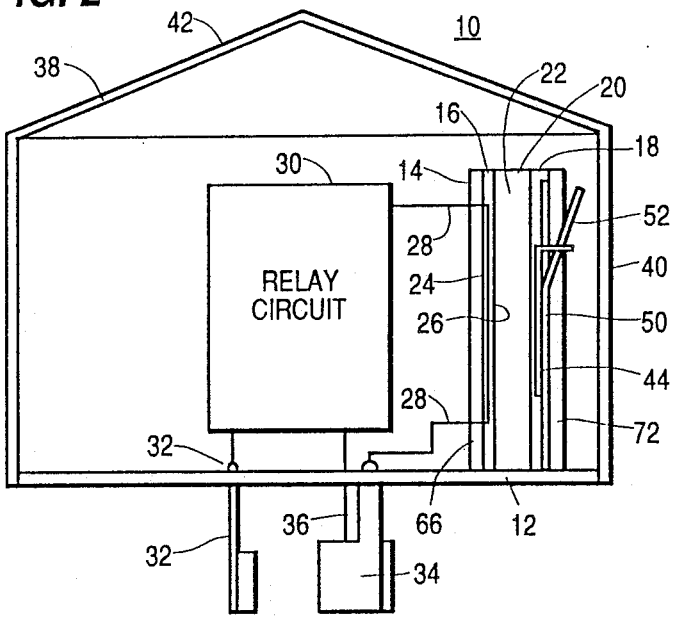
FIG. 2 is a partly vertical section 2—2 of FIG. 1.
Figure 3:
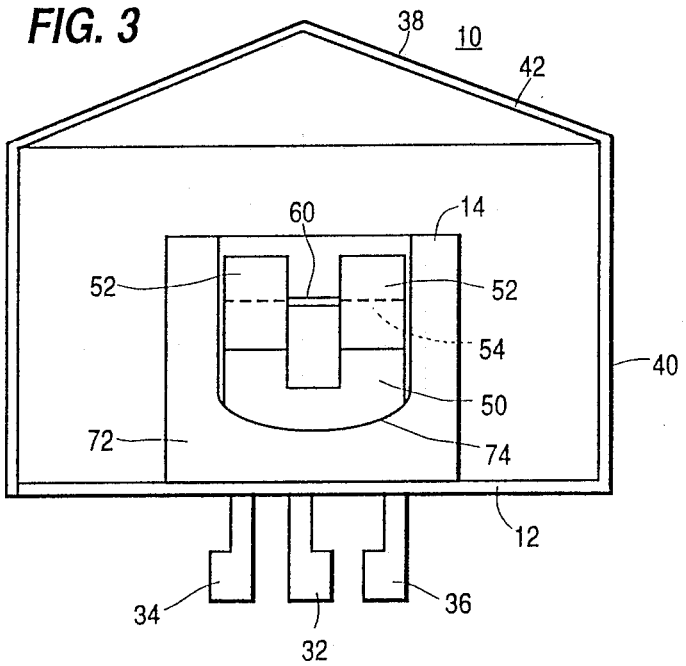
FIG. 3 is a side view of FIG. 1 with the dome of FIG. 1 in section.

In FIGS. 1, 2, and 3 an outdoor lighting control 10 according to the invention includes a plastic disc-shaped base 12 having an integrally upstanding socket 14 with a pair of grooves 16 and 18 separated from each other by shoulders 20. The base 12 and the socket 14 are of opaque plastic. The shoulders form a gap 22 between the grooves 16 and 18. A flat photocell 24 having a photosensitive surface 26 rests firmly in the groove 16. Suitable wires 28 connect the photocell 24 to a schematically-shown relay circuit 30 and three bayonet connectors 32, 34, and 36 which serve to electrically join the control 10 with one or more street lamps to be switched on or off. An example of a circuit for use in the relay circuit 30 appears in U.S. Pat. No. 3,351,762.

A translucent "dome" 38 covers the members 14 to 30 and firmly holds the base 12 at its periphery. The dome 38 includes a translucent cylindrical dome wall 40 and a translucent conical roof 42 integral with the dome wall.

Figure 4:
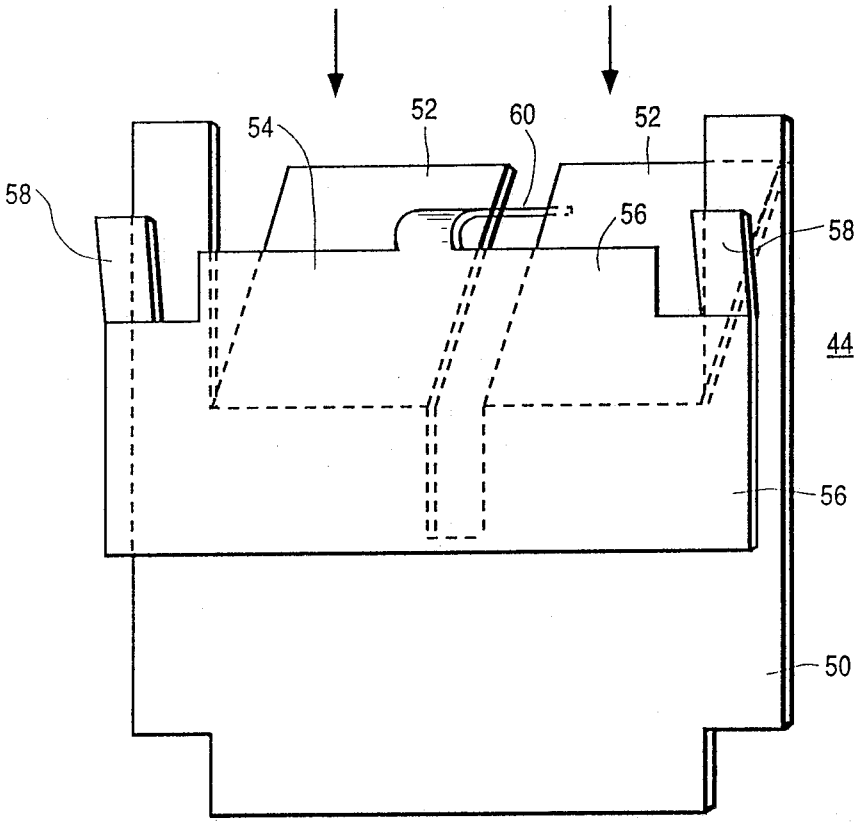
FIG. 4 is perspective view of a reflector assembly in FIGS. 1 to 3.
Figure 5:
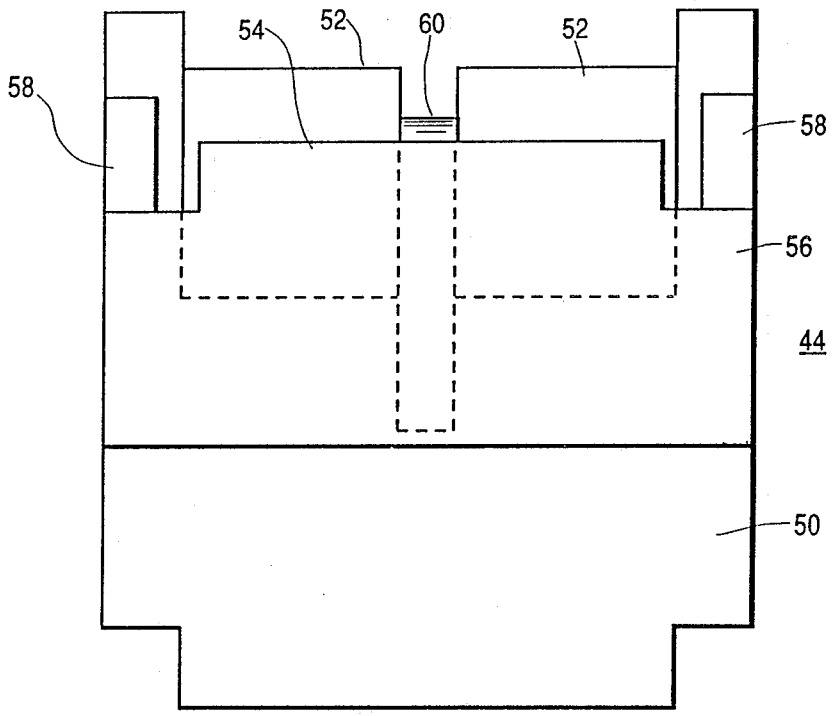
FIG. 5 is an elevation of the assembly in FIG. 4.
Figure 6:
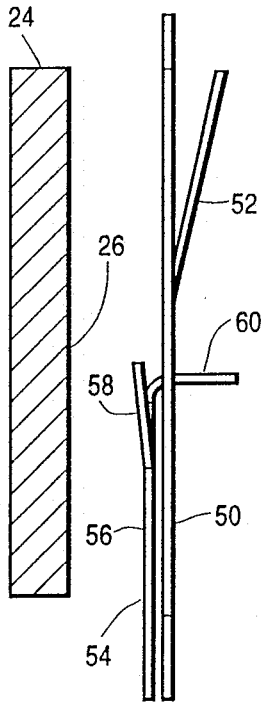
FIG. 6 is a side elevation of the reflector assembly of FIG. 4 with an adjuster in one position.
Figure 7:
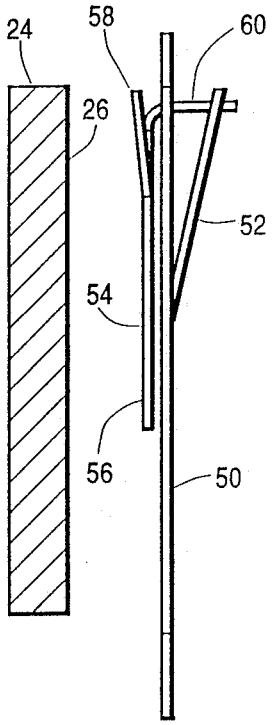
FIG. 7 is a side elevation of the reflector assembly of FIG. 4 with an adjuster in another position.

An opaque adjustable reflector assembly 44 in the groove 18 reflects light entering the dome 38 from above the control 10 toward the surface 26 of the photocell 24. The reflector assembly 44 includes an opaque reflector plate 50 with two angularly extending reflecting vanes 52 integrally bent out of the plane of the plate 50 as shown more completely in FIGS. 4 to 7. In the perspective view of FIG. 4 and the elevation of FIG. 5 the views are taken from the photocell 24 toward the assembly 44.

The vanes 52 project from about the center of the plate 50 and are angled from the vertical to reflect diffused light coming from the translucent dome 38 into the gap 22 and onto the surface 26 of the photocell 24. The angle of departure of the vanes 52 from the plane of the plate 50 is approximately 12 degrees. The diffused light from the dome 38 arrives in the gap 22 between the photocell 24 from a number of downward directions. Although the vanes 52 are less than half the area of the photosensitive surface 26, the angle of the vanes is such as to spread the light over the photosensitive area.

A rigid, shade-like, vertically movable, and opaque adjuster 54 occupies the groove 18 with the plate 50. The adjuster 54 includes a rigid central sheet 56 and two integral spring tabs 58 bent inwardly to hold the adjuster resiliently in place within the groove 18. A handle 60 integrally formed with the sheet 56 extends between the vanes 52 and horizontally out of the socket 14. One can then vary the vertical position of the adjuster 54 by removing the dome 38 and shifting the handle 60 up or down as desired. Moving the handle 60 down to the place presented schematically in the side elevation of FIG. 6 exposes the surface 26 of the photocell 24 to more light. Displacing the handle 60 upwardly causes the opaque sheet to slide up to the location depicted in FIG. 7 and block more and more of the light that the vanes 52 reflect onto the photocell 24. In this way one can change the operating point of the photocell 24 and the sensitivity of the control 10 on a continuous infinitely-variable basis.

Altering the operating point of the photocell 24 and the sensitivity of the control is significant because the characteristics of photocells vary widely. Shifting the adjuster 54 allows one to accommodate the operation of the control 10 to the variations in the characteristics of the particular photocell. It further permits setting the controller to switch at different light intensities for different purposes.

The light blocking property of the adjuster 54 is preferably obtained by using black anodized aluminum or black molded plastic therefor. The reflective property of the vanes 52 is preferably achieved with nickel plated aluminum. Other suitable opaque or reflecting materials may also be used.

The opaque material of the socket 14 protects the photocell 24 from light entering the dome 38 horizontally. In the embodiment of the invention shown, three socket walls 66, 68, and 70 extend upwardly beyond the top of the photocell 24. However, a fourth socket wall 72 contains a gouge 74 which permits the vanes 52 to project beyond the socket 14. The opaque plate 50, the vanes 52, and the opaque sheet 56 in the assembly 44 shield the photocell 24 from most of the horizontal light coming from the direction of the gouge 74.

In operation the control 10 switches street lamps on and off in response to lighting conditions above the control, for example in the sky at the azimuth. Light from the sky enters the translucent roof 38 and strikes the reflective vanes 52 which reflect the light onto the photosensitive surface 26 of the photocell 24. Some light impinges directly upon the surface 26 from the dome 38 especially through the roof 42. When the light is bright, the resistance of the photocell 24 is low and when the light is dim, the resistance is high. The resistance of the photocell 24 controls the operation of the relay circuit 30 and the conditions at which the control 10 switches current to a lamp on or off. The bayonet connectors 32, 34, and 36 connect the relay circuit 30 into the circuit between a power line and the lamp or lamps to be controlled. Modifying the position of the adjuster 54 determines at what intensity of light the control 10 turns the lamps on or off.

The invention provides for continuous adjustment of the amount of light that reaches the surface of the photocell 24. By moving the adjuster 54 upward, more surface of the cell is blocked from the reflected light. As the adjuster 54 is moved downward, more light is allowed to reach the surface of the cell. Once the position of the adjuster is such that a desirable operating point of the photo is achieved, the spring tabs 58 on the adjuster hold the adjuster in that position. The adjuster 54 therefore operates as a shutter or curtain for the operation of the photocell 24.

The invention makes it possible to use a horizontal base and a vertical photocell for sensing light from above as well as to sense light from a single horizontal direction such as North. This simplifies the manufacturing processes for both types of devices.

One purpose of the conical shape of the roof 42 is to discourage birds from sitting thereon.

While embodiments of the invention have been described in detail it will be evident to those skilled in the art that the invention may be embodied otherwise without departing from its spirit.

I claim:

1. A lighting control, comprising:

a base having a major surface along one plane;

a circuit mounted on the base for connection to a network to be controlled;

a photocell in the network and having a photosensitive surface;

means on the base for mounting said photocell so that the photosensitive surface is transverse to the direction of the plane of the base;

a translucent cover covering said circuit and said base; and reflector means for reflecting light directed transverse to the direction of the plane of the base toward said photosensitive surface and blocking the photosensitive surface from light in a direction along the plane of said base.

2. A control as in claim 1, wherein said means for mounting said photocell includes a socket projecting transverse to the plane of the base and holding said photocell so as to block light rays along the plane of the base from directions other than said reflective means.

3. A control as in claim 1, wherein said reflective means includes reflectors oriented angularly relative to said photosensitive surface.

4. A control as in claim 1, wherein:

said reflector means includes a reflector portion oriented angularly relative to said photosensitive surface to reflect light from a direction transverse to the base plane toward the photo sensitive surface and a second portion transverse to the base plane;

said reflector means is substantially opaque; and holding means serve for permitting adjustment of said reflector means toward and away from said base so as to vary the amount of light reflected toward said photosensitive surface.

5. A control as in claim 1, wherein said reflector means is opaque.

* * * * *